US007854335B2

(12) United States Patent
Lin et al.

(10) Patent No.: US 7,854,335 B2
(45) Date of Patent: Dec. 21, 2010

(54) HANGING MODULE FOR HOLDING WORKPIECES

(75) Inventors: Chih-Pen Lin, Taipei Hsien (TW); Yu-Chuan Chen, Shenzhen (CN); Peng Qin, Shenzhen (CN); Xiao-Lin Wu, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 406 days.

(21) Appl. No.: 11/964,867

(22) Filed: Dec. 27, 2007

(65) Prior Publication Data

US 2009/0101611 A1 Apr. 23, 2009

(30) Foreign Application Priority Data

Oct. 19, 2007 (CN) ..... 2007 1 0202153

(51) Int. Cl.
*A47H 13/00* (2006.01)

(52) U.S. Cl. ..... 211/120

(58) Field of Classification Search ..... 211/120, 211/123, 124, 89.01, 119.13, 181.1, 119, 211/189, 206, 204, 182, 119.009
See application file for complete search history.

(56) References Cited

U.S. PATENT DOCUMENTS 298,379 A * 5/1884 Heysinger ..... 211/69.8
312,742 A * 2/1885 Meinhardt ..... 211/120
482,664 A * 9/1892 Weissenborn ..... 118/503
495,102 A * 4/1893 Reid ..... 211/120
1,205,747 A * 11/1916 Kawate ..... 211/51
1,362,136 A * 12/1920 Plante ..... 396/652
1,999,310 A * 4/1935 Thompson ..... 223/91
2,118,957 A * 5/1938 Wagner ..... 204/297.09
2,279,643 A * 4/1942 Silver ..... 211/11
2,459,006 A * 1/1949 Sova ..... 211/85.3
2,478,809 A * 8/1949 Deal ..... 211/120
2,522,416 A * 9/1950 Weiskopf ..... 118/503
2,674,826 A * 4/1954 Busse ..... 43/57.1
2,867,161 A * 1/1959 Padgett ..... 396/652
3,056,621 A * 10/1962 Edridge ..... 294/5.5
D206,207 S * 11/1966 Stein ..... D6/319
3,343,683 A * 9/1967 Wheeler ..... 211/89.01
3,498,469 A * 3/1970 Hummel ..... 211/85.15
3,946,878 A * 3/1976 Stoveken et al. ..... 211/124
4,108,315 A * 8/1978 Inao ..... 211/124
4,492,309 A * 1/1985 Fedoryshyn ..... 211/65
5,137,151 A * 8/1992 Choate ..... 206/370
6,021,907 A * 2/2000 O'Brien ..... 211/89.01
7,083,057 B1 * 8/2006 Hatch ..... 211/120

FOREIGN PATENT DOCUMENTS

CN 1498694 5/2004

* cited by examiner

*Primary Examiner*—Jennifer E. Novosad
(74) *Attorney, Agent, or Firm*—Jeffrey T. Knapp

(57) ABSTRACT

A hanging module (100) for holding workpieces (80) thereon includes a pole (30), a plurality of resilient members (20) attached on the pole, and a plurality of retaining members (10) attached on the pole. The resilient members are slidable relative to the pole. Each retaining member is provided apart from each other with at least one resilient member located in-between.

3 Claims, 7 Drawing Sheets

HANGING MODULE FOR HOLDING WORKPIECES

BACKGROUND OF THE INVENTION

1. Field of the Invention

The present invention generally relates to modules configured (i.e., structured and arranged) for holding workpieces, particularly to a module configured for supporting workpieces, such as housings of portable electronic devices.

2. Description of Related Art

With the development of wireless communication and information processing technologies, portable electronic devices, such as mobile telephones and electronic notebooks, are now in widespread use. These portable electronic devices enable consumers to enjoy high technology services, almost anytime and anywhere.

Housings of such portable electronic devices are mass-produced in manufacturing. In the process of manufacturing, each housing has trademark printed thereon. In order to improve efficiency, hanging apparatuses are used for carrying housings. Referring to FIGS. 6-7, a typical hanging apparatus 300 includes a pole 310, a plurality of mounting rods 301 fixed on the pole 310 side by side, and a plurality of retaining members 400 fixed on the mounting rods 301 by bolts. Each retaining member 400 is substantially V-shaped and has two mounting portions 402, 404 respectively formed at two distal ends thereof. The mounting portion 402 is substantially V-shaped and has two v-shaped distal ends. The mounting portion 404 is a rod with a v-shaped distal end. The two mounting portions 402, 404 cooperate to hold a workpiece thereon. However, the distance between the two mounting portions 402, 404 cannot be adjusted according to the different sizes of the workpieces.

Therefore, a new apparatus for holding workpieces is desired in order to overcome the above-described shortcomings.

SUMMARY

In one aspect thereof, a hanging module for holding workpieces includes a pole, a plurality of resilient members attached on the pole, and a plurality of retaining members attached on the pole. The resilient members are slidable relative to the pole. Each retaining member is provided apart from each other with at least one resilient member located in-between.

Other advantages and novel features of the embodiments will become more apparent from the following detailed description thereof when taken in conjunction with the accompanying drawings.

BRIEF DESCRIPTION OF THE DRAWINGS

Many aspects of the present hanging module for holding workpieces can be better understood with reference to the following drawings. The components in the drawings are not necessarily drawn to scale, the emphasis instead being placed upon clearly illustrating the principles of the hanging module and its potential applications. Moreover, in the drawings, like reference numerals designate corresponding parts throughout the several views.

DETAILED DESCRIPTION OF THE EMBODIMENTS

Figure 1:
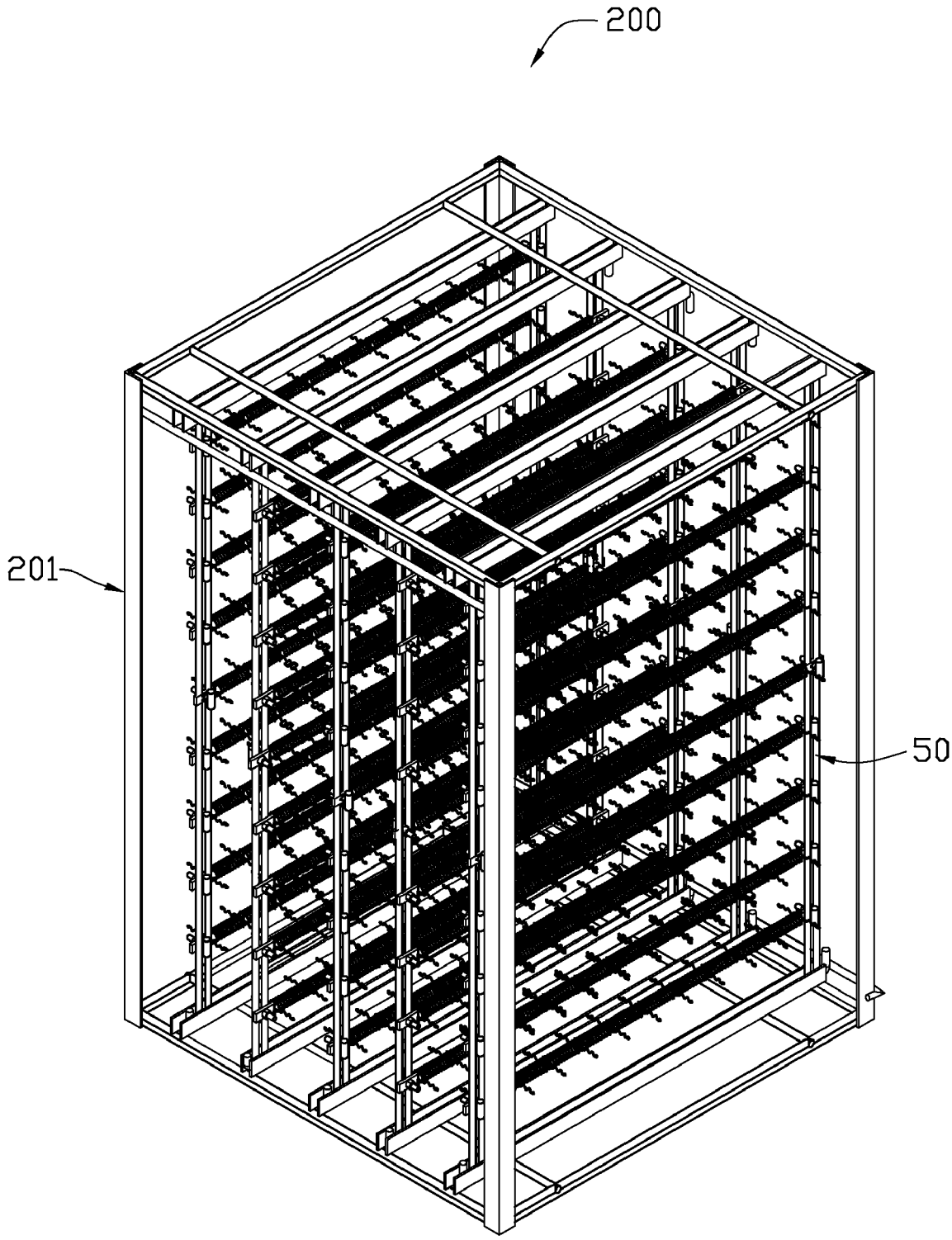
FIG. 1 is an isometric view of an apparatus using a plurality of hanging modules in accordance with a present embodiment.
Figure 4:
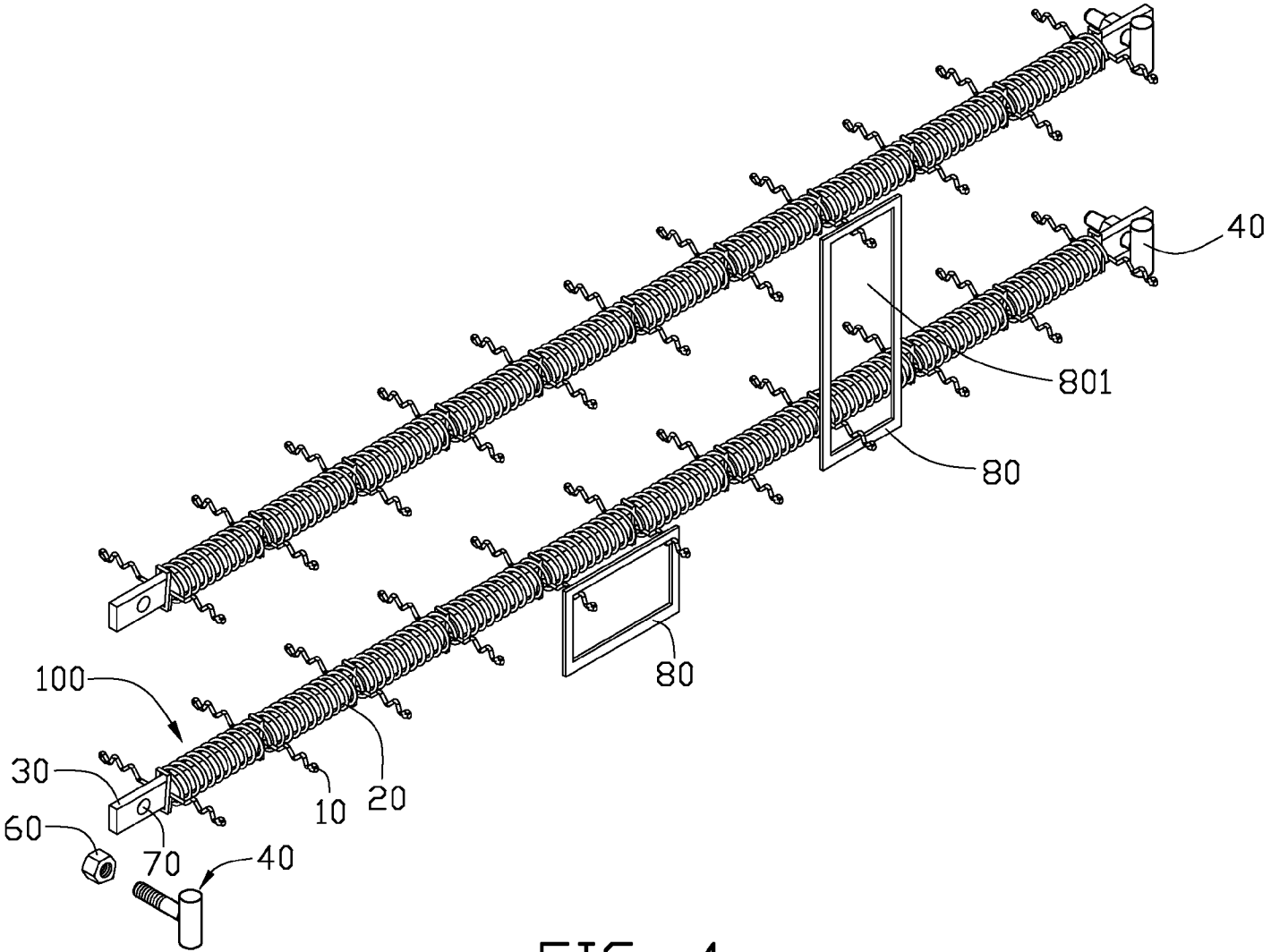
FIG. 4 is an isometric view of two hanging modules holding a workpiece.

Referring to FIGS. 1 and 4, an apparatus 200 according to a present embodiment is shown. The apparatus 200 is configured for holding workpieces 80 such as housings of portable electronic devices. The workpiece 80 is a substantially rectangular frame and has a hole 801 defined therethrough. The apparatus 200 includes a rack 201, a plurality of frames 50 slidably received in the rack 201. Each frame 50 is equipped with a plurality of hanging modules 100.

Figure 2:
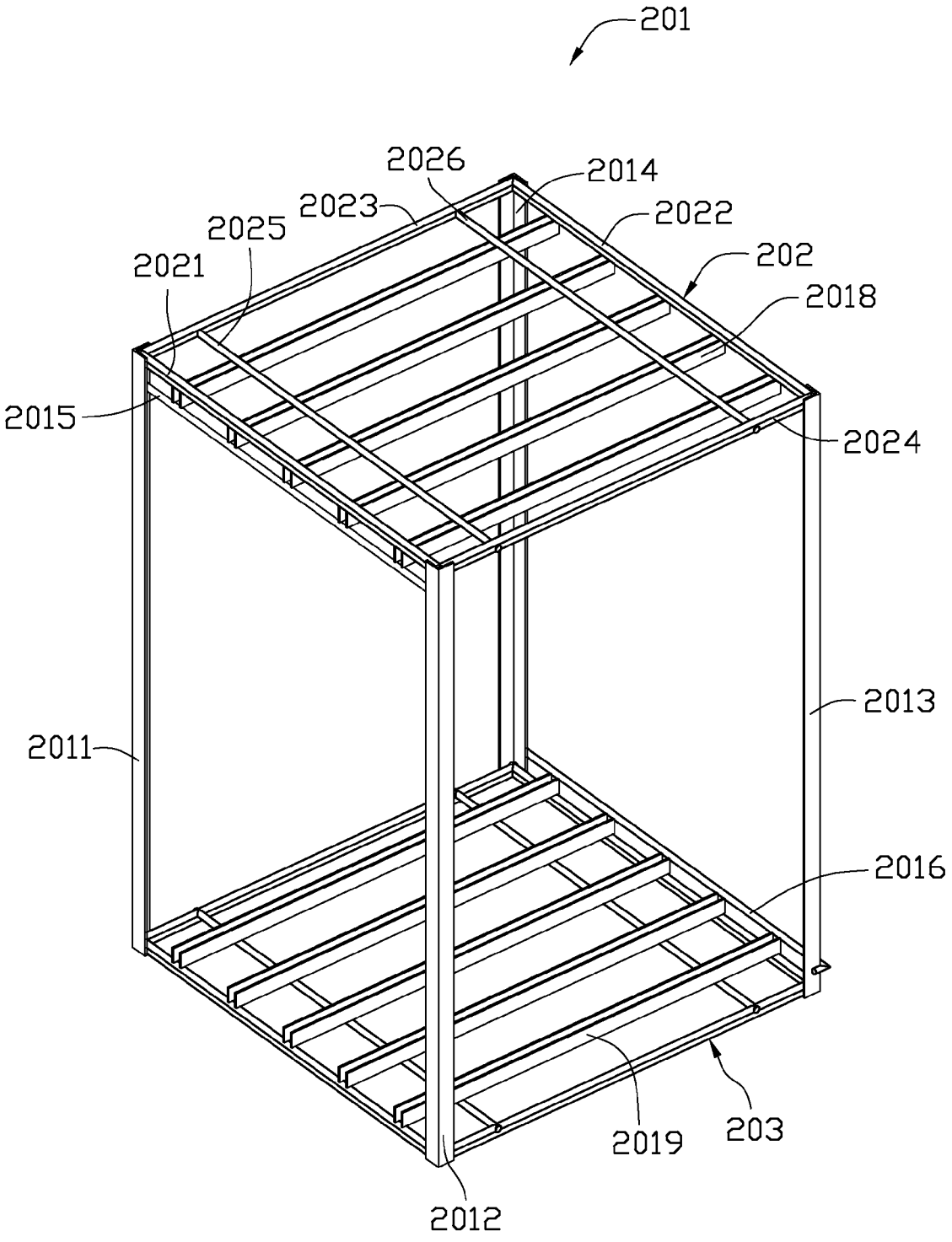
FIG. 2 is an isometric view of a rack of the apparatus shown in FIG. 1.

Also referring to FIG. 2, the rack 201 includes a top frame 202, a bottom frame 203 facing to the top frame 202, four supporting poles 2011, 2012, 2013, 2014, an upper positioning pole 2015 adjacent to the top frame 202, and a lower positioning pole 2016 adjacent to the bottom frame 203. The top frame 202 is substantially rectangular in shape and has four sides 2021, 2022, 2023, 2024, a plurality of mounting rails 2018, and two strengthening poles 2025, 2026. The side 2021 is parallel to the side 2022. The side 2023 is parallel to the side 2024. The plurality of mounting rails 2018 are fixed between the sides 2021, 2022 and are parallel to the sides 2023, 2024. Each mounting rail 2018 has two parallel, long, narrow, and rectangular plates. The strengthening poles 2025, 2026 are fixed between the sides 2023, 2024 and are parallel to the sides 2021, 2022.

The bottom frame 203 is similar to the top frame 202. Each mounting rail 2019 of the bottom frame 203 is configured for engaging with a corresponding mounting rail 2018 of the top frame 202 in order to guide a corresponding frame 50. Each of the supporting poles 2011, 2012, 2013, 2014 connects with a corresponding corner of the top frame 202 and bottom frame 203. The upper positioning pole 2015 is fixed between the supporting poles 2011, 2012 and is parallel to the sides 2021, 2022. The lower positioning pole 2016 is located between the supporting poles 2013, 2014 and is parallel to the sides 2021, 2022. The lower positioning pole 2016 has two L-shaped ends so as to slide along the supporting poles 2013, 2014.

Figure 3:
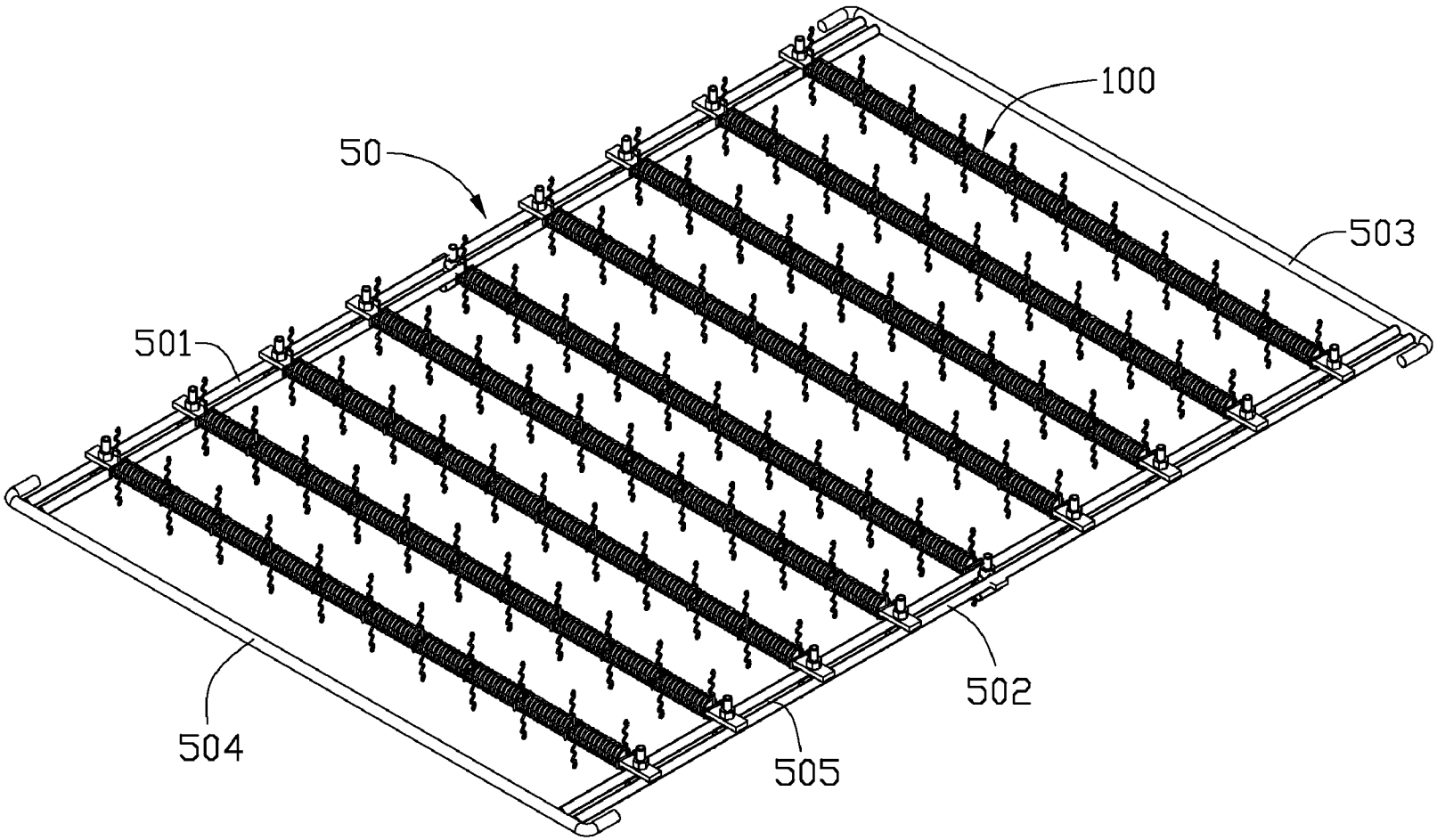
FIG. 3 is an isometric view of a frame and a plurality of hanging modules of the apparatus shown in FIG. 1.

Also referring to FIG. 3, each frame 50 is substantially rectangular in shape and has two long sides 501, 502 and two short sides 503, 504. Each of the long sides 501, 502 has two rods arranged apart and parallel with each other thereby defining a slot 505 therebetween. Each of the short sides 503, 504 has two L-shaped ends. Each of the long sides 501, 502 is fixed between two corresponding L-shaped ends respectively of the short sides 503, 504.

Figure 5:
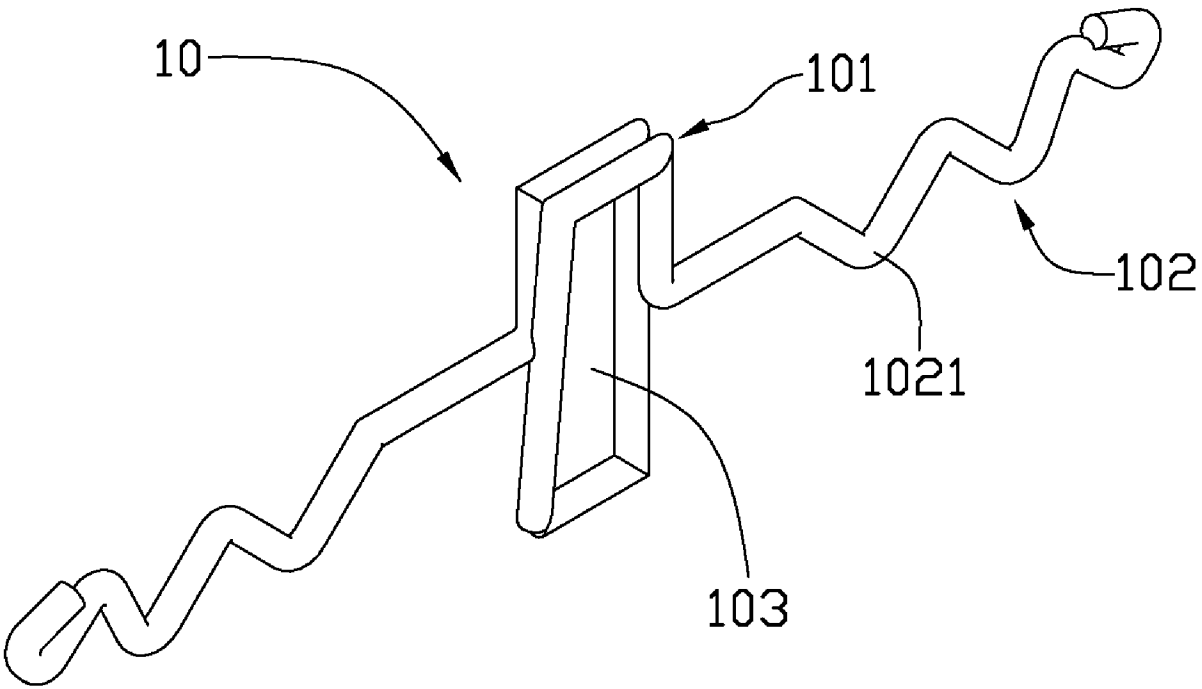
FIG. 5 is an isometric view of a retaining member of the hanging module shown in FIG. 4.
Figure 6:
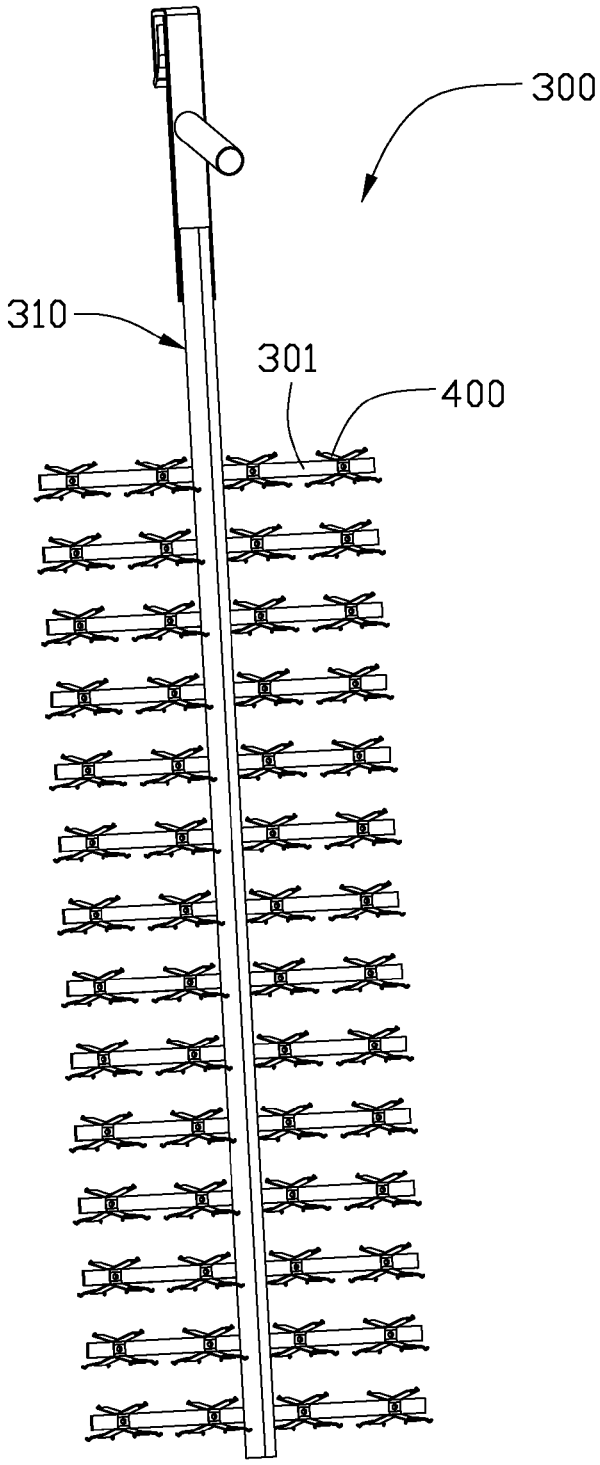
FIG. 6 (RELATED ART)
FIG. 6 is an isometric view of a conventional hanging apparatus.
Figure 7:
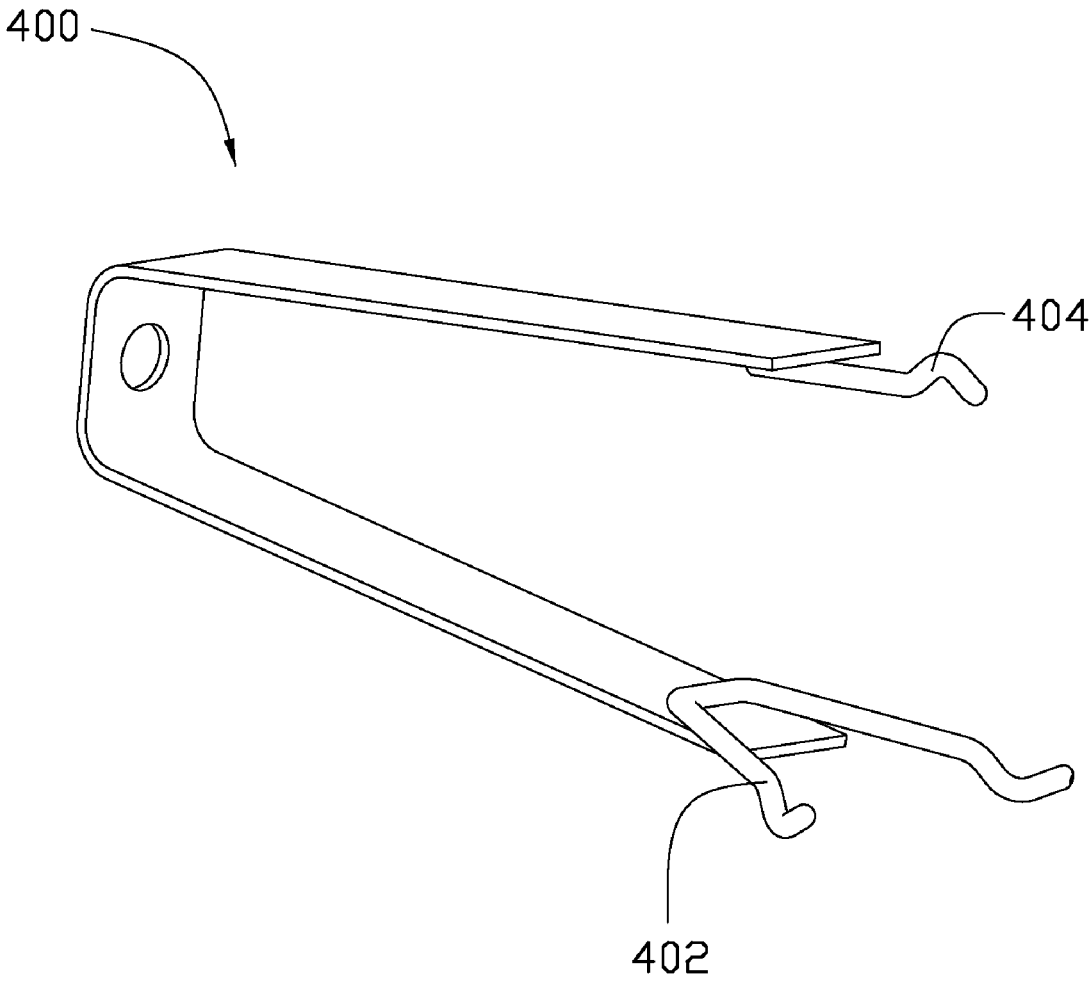
FIG. 7 (RELATED ART)
FIG. 7 is an isometric view of a retaining member of the hanging apparatus shown in FIG. 6.

Also referring to FIGS. 4-5, each hanging module 100 includes a pole 30, a plurality of retaining members 10 surrounding the pole 30, a plurality of resilient members 20 surrounding the pole 30, two bolts 40, and two nuts 60. The pole 30 is a long and rectangular plate and has two opposite sides defining two bolt holes 70 therein. The retaining members 10 are preferably made of stainless steel. Each retaining member 10 has a positioning body 101 and two arms 102 extending respectively away from two opposite ends of the positioning body 101. The positioning body 101 is a substantially rectangular frame and is configured for surrounding the pole 30 so that the positioning body 101 is slidable relative to the pole 30 and is rotatable with the pole 30. Each arm 102 is substantially W-shaped and has a first end directly extending from the positioning body 101 and an opposite second end bent towards the first end.

Each resilient member 20 may be a spiral spring or a cylindrical rubber. Each retaining member 10 is provided apart from each other with at least one resilient member 20 located in-between. Also referring to FIG. 3, each resilient member 20 may be in its original state (i.e., the resilient member 20 is not elongate or compressed) or compressed. Each hanging module 100 is attached to the frame 50 with a fastening means. In the present embodiment, the fastening means includes a bolt 40 and a nut 60. A corresponding bolt 40 is inserted through a corresponding bolt hole 70, a corresponding slot 505 and secured with a corresponding nut 60. Each hanging module 100 is located between the two long sides 501, 502 and is parallel to the two short sides 503, 504. Each arm 102 is substantially perpendicular to the two long sides 501, 502 and the two short sides 503, 504.

In use, two corresponding arms 102 of two adjacent hanging modules 100 travel through the hole 801 thereby holding the workpiece 80 on the hanging modules 100. In a same way as detailed above, a plurality of workpieces 80 may be fixed to the hanging modules 100. Then, the lower positioning pole 2016 is moved towards the bottom frame 203. Each frame 50 secured with plurality of hanging modules 100 is inserted into the rack 201 by inserting the two short sides 503, 504 respectively into two corresponding mounting rails 2018, 2019 of the top frame 202 and the bottom frame 203. After the frames 50 being received in the rack 201, the lower positioning pole 2016 is moved upwardly along the sides 2013, 2014 thereby cooperating with the upper positioning pole 2015 to secure the frames 50 in the rack 201.

It should be understood that the workpiece 80 may be fixed to the hanging module 100 by mounting the workpiece 80 to the two corresponding arms 102 of two adjacent retaining members 10 secured on the same pole 30. The distance between two corresponding arms 102 for holding workpiece 80 may be adjusted by changing the resilient member 20 located therebetween or by changing the distance between two adjacent poles 30.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An apparatus for holding workpieces, comprising:

a frame being substantially rectangular in shape and having two first parallel sides, each of the two first parallel sides defining a slot therein and having two rods arranged apart and parallel with each other thereby forming the slot therebetween; the frame further having two second parallel sides, each of the two second parallel sides having two L-shaped ends; each of the first sides being fixed between two corresponding L-shaped ends respectively of the second sides; and a plurality of hanging modules fixed on the frame, each hanging module comprising:

a pole having two opposite ends defining two holes therein, and the pole being fixed to the two first parallel sides;

a plurality of resilient members attached on the pole, the resilient members being slidable relative to the pole; and a plurality of retaining members attached on the pole, each retaining member being provided apart from each other with at least one resilient member located in-between; the retaining members having substantially different structures from the resilient members.

2. An apparatus for holding workpieces, comprising:

a rack;

a frame slidably received in the rack; and a plurality of hanging modules fixed on the frame, each hanging module comprising:

a pole;

a plurality of resilient members attached on the pole, the resilient members being slidable relative to the pole; and a plurality of retaining members attached on the pole, each retaining member being provided apart from each other with at least one resilient member located in-between; the retaining members having substantially different structures from the resilient members, wherein the rack include a top frame, a bottom frame facing to the top frame and four supporting poles connecting with corresponding four corners of the top frame and bottom frame, both the top frame and the bottom frame define a mounting rail for engaging with two ends of the frame and guiding the frame.

3. The apparatus as claimed in claim 2, wherein both the top frame and the bottom frame are substantially rectangular and include four sides and two strengthening pole, the mounting rails are fixed between two opposite sides and parallel to the other two opposite sides of the corresponding top frame and bottom frame.

* * * * *